US005163373A

United States Patent [19]

Anderson et al.

[11] Patent Number: 5,163,373

[45] Date of Patent: Nov. 17, 1992

[54] FURNITURE WITH IMPROVED LEG CONSTRUCTION

[75] Inventors: Bradley T. Anderson, Muskegon; Larry L. Loser, Zeeland, both of Mich.

[73] Assignee: Herman Miller, Inc., Zeeland, Mich.

[21] Appl. No.: 762,615

[22] Filed: Sep. 19, 1991

[51] Int. Cl.[5] ..... A47B 3/06

[52] U.S. Cl. ..... 108/153; 108/156; 248/188

[58] Field of Search ..... 108/153, 156, 157; 248/188.8, 188.4, 188.1, 188

[56] References Cited

U.S. PATENT DOCUMENTS

| | | | |
|---|---|---|---|
| 1,816,247 | 7/1931 | Buckman et al. | 108/153 |
| 1,870,173 | 8/1932 | Calton | 108/156 X |
| 1,876,336 | 9/1932 | McLaughlin | 248/188 |
| 2,903,312 | 9/1959 | Lawless . | |
| 3,204,905 | 9/1965 | Marban | 248/188 |
| 3,329,383 | 7/1967 | Pilliod et al. . | |
| 3,497,170 | 2/1970 | Armstrong . | |
| 3,846,211 | 11/1974 | Begin et al. . | |
| 3,912,210 | 10/1975 | von Bohr . | |
| 3,999,236 | 12/1976 | Macauley | 248/188 X |
| 4,290,371 | 9/1981 | Snitzer et al. . | |
| 4,632,040 | 12/1986 | Sheffer . | |
| 4,941,412 | 7/1990 | Engel | 108/156 |
| 4,946,224 | 8/1990 | Leib . | |
| 5,050,829 | 9/1991 | Syices | 248/188.8 |

*Primary Examiner*—Jose V. Chen

*Attorney, Agent, or Firm*—Varnum, Riddering, Schmidt & Howlett

[57] ABSTRACT

A leg constuction (18) for supporting the weight of an upper member (12) in an article of furniture (10) comprises an elongated metal support member (20) adapted to be secured to the upper member and of sufficient length to support the upper member above the floor. The metal support member has at least one elongated retaining tongue (30, 32) extending along at least a portion of the length of the metal support member. An elongated wooden cover member (72) is mounted on the metal support member, the elongated cover member having a length substantially coextensive with the metal support member for covering the metal support member. In addition, the cover member has at least one elongated retaining groove (86, 88) for slidably receiving the elongated retaining tongue of the metal support member, thereby slidably retaining the cover member on the metal support member. The cover member substantially conceals the metal support member from view from at least one side of the furniture article.

15 Claims, 3 Drawing Sheets

FURNITURE WITH IMPROVED LEG CONSTRUCTION

BACKGROUND OF THE INVENTION

1. Field of the Invention

This invention generally relates to articles of furniture and in particular to tables having a novel leg construction.

2. Description of the Related Art

Tables, chairs and other furniture products which are made of wood provide for a warm residential appearance — even if used as office furniture. Metal tables and chairs can be extremely functional and durable by virtue of the strength characteristics imparted by metal but do not create the warm ambience provided by wood. Wood, on the other hand, does not necessarily provide adequate strength for chairs and tables which can be routinely subjected to extreme wear and tear, especially in the workplace. It has been recognized in the furniture industry that the attributes of wood and metal can be combined into a single article of furniture such as a chair.

For instance, a chair comprising a combination of metal and wooden members is disclosed in U.S. Pat. No. 4,946,224 to Leib, issued Aug. 7, 1990. This patent discloses a chair supported by two wooden side members, each of which forms a front leg, an armrest, a rear leg and a bottom runner. Each front leg has a rectangular metal post mounted therein which is inset from an inside face of the front leg. A wooden panel or plate can be placed over the rectangular metal post to conceal the rectangular post in the wooden front leg.

There have been other attempts in the furniture industry to provide a table or chair leg with a reinforcing member and a decorative cover to conceal the reinforcing member. For example, U.S. Pat. No. 3,846,211 to Begin et al., issued Nov. 5, 1974, discloses a wooden table or chair leg having a shallow longitudinal recess for receiving a reinforcing member which comprises a bundle of glass fibers bound with resin. Begin et al. disclose that a facing of ornamental configuration can be molded directly onto the furniture leg in order to conceal the reinforcing member. It would be preferable if the reinforcing member were made of metal to provide for a stronger construction, and if an ornamental facing would not have to be molded over the reinforcing member to conceal the reinforcing member.

SUMMARY OF THE INVENTION

The invention relates to an article of furniture, such as a table, having a leg construction for supporting the weight of an upper member in the article of furniture wherein the leg construction comprises an elongated metal support member adapted to be secured to the upper member and of sufficient length to support the upper member above the floor. The improved leg construction comprises the metal support member having at least one elongated retaining tongue extending along at least a portion of the length of the metal support member.

An elongated decorative cover member is mounted on the metal support member, the elongated cover member having a length substantially coextensive with the metal support member for covering the metal support member. In addition, the cover member has at least one elongated retaining groove for slidably receiving the elongated retaining tongue of the metal support member and thereby slidably retaining the cover member on the metal support member. The cover member substantially conceals the metal support member from view from at least one side of the furniture article.

The cover member is preferably made of wood. The metal support member preferably comprises two elongated retaining tongues while the cover member preferably comprises two elongated retaining grooves. The metal support member preferably includes two elongated plates, each having a first elongated edge. The elongated plates can be mounted to each other along the first elongated edges such that the elongated plates are disposed at right angles to each other. With this construction, the metal support member has an L-shaped cross section.

Each of the elongated plates can also include a second elongated edge opposite from the first elongated edge. The elongated retaining tongues are preferably integral with the respective second elongated edges.

The invention also relates to the cover member further comprising a concave outside surface, a block portion and two opposing leg portions, each of the opposing leg portions cooperating with the block portion to form the two elongated retaining grooves.

The metal support member can include at least one aperture adapted to receive a fastener, the fastener extending through the metal support member and bearing against the cover member for fixedly mounting the cover member to the metal support member. In addition, the leg construction can include a metal plate secured to an upper portion of the metal support member. The metal plate can be securely mounted to a bottom surface of the upper member of the article of furniture. Further, one or more metal gussets can be secured to an undersurface of the metal plate and to the metal support member in such a manner that sufficient space is provided for a valance to extend to and abut the metal support member.

The invention also relates to a means attached to the metal support member for raising and lowering the metal support member with respect to the floor. Further, the invention is particularly useful if three or more of the improved leg constructions are utilized to support the top of a table above the floor.

The improved furniture leg construction of the present invention is strong and durable, yet retains a substantially wooden appearance. Further, the leg construction is easily assembled or constructed, and the strengthening properties of the metal support member are effectively utilized. In the combination wood-metal leg construction of the invention, the metal support member serves as the primary support element and the cover member serves a primarily decorative function.

BRIEF DESCRIPTION OF THE DRAWINGS

The invention will now be described with reference to the drawings in which.

DETAILED DESCRIPTION OF THE PREFERRED EMBODIMENTS

Figure 1:
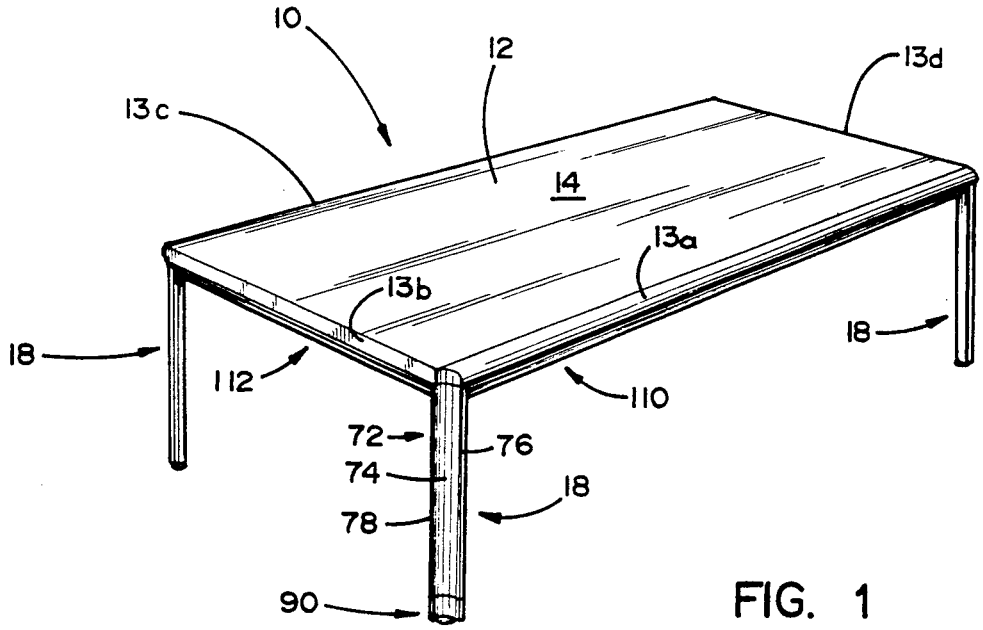
FIG. 1 is a perspective view of a table embodying a novel table leg construction according to the invention.
Figure 2:
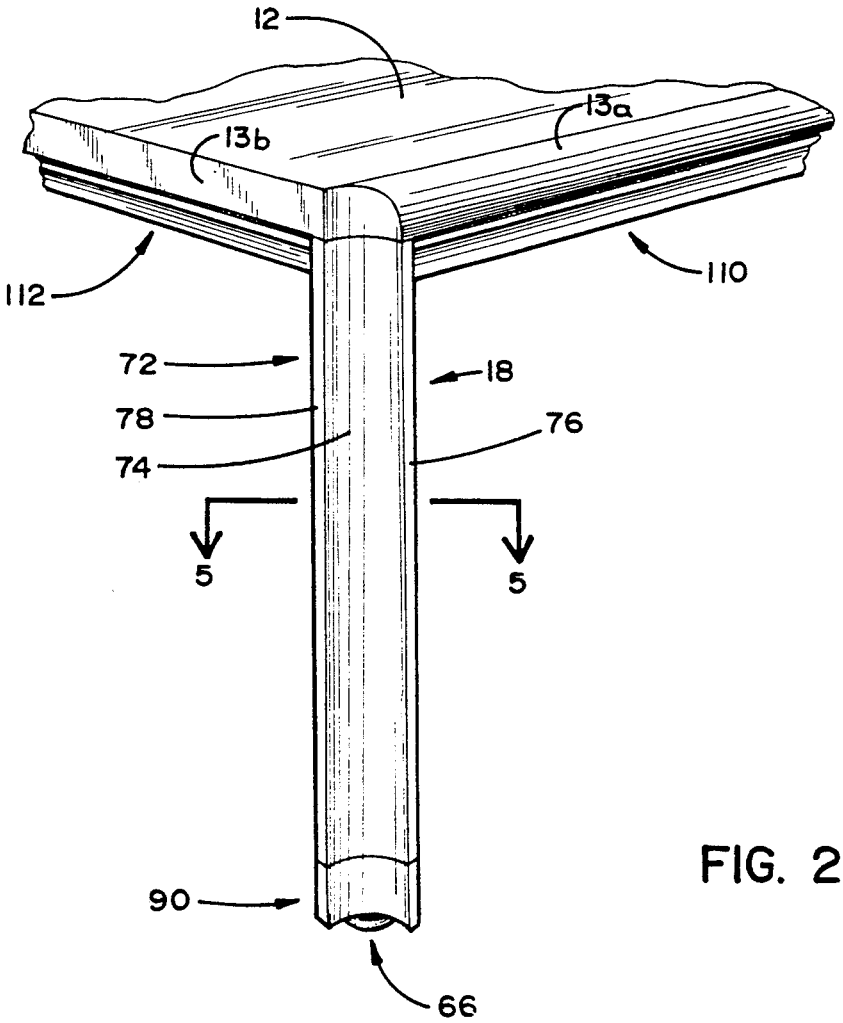
FIG. 2 is enlarged view of the table leg construction shown in FIG. 1, the view being taken from outside the boundaries of the table and looking toward the table leg construction.
Figure 3:
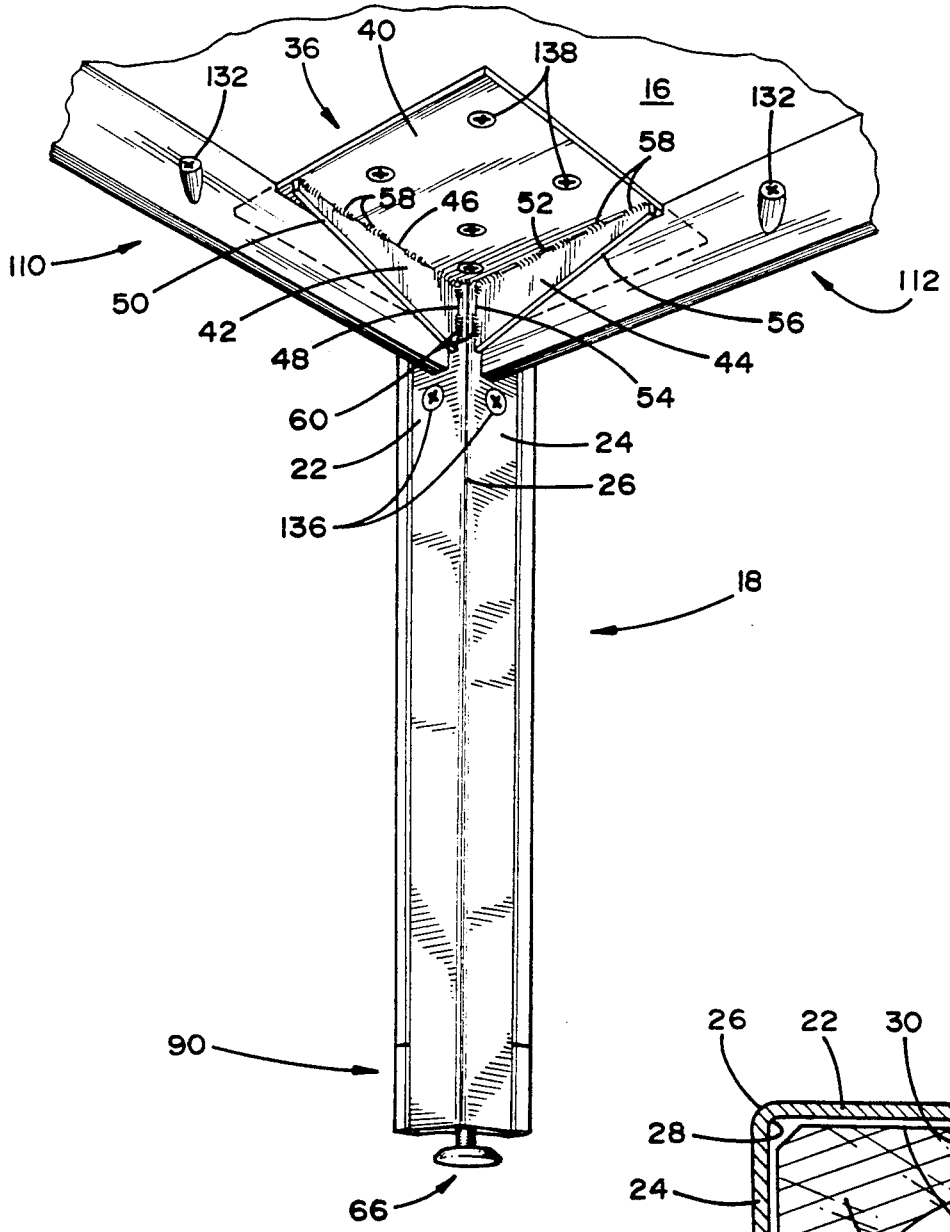
FIG. 3 is a view which is similar to FIG. 2 but wherein the view is taken from inside the boundaries of the table and underneath a horizontal work surface of the table, and looking toward the table leg construction.

Referring now to the drawings, and in particular to FIGS. 1-3, a table 10 has a horizontal support 12 which is typically used as a work surface. The horizontal support 12 includes a top surface 14 and a bottom surface 16, the bottom surface 16 having a novel table leg construction 18 attached thereto and extending downwardly toward the floor or ground.

Figure 5:
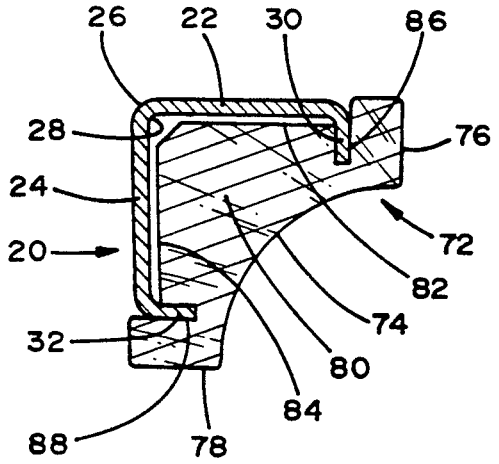
FIG. 5 is a sectional view taken along the lines 5—5 of FIG. 2.
Figure 4:
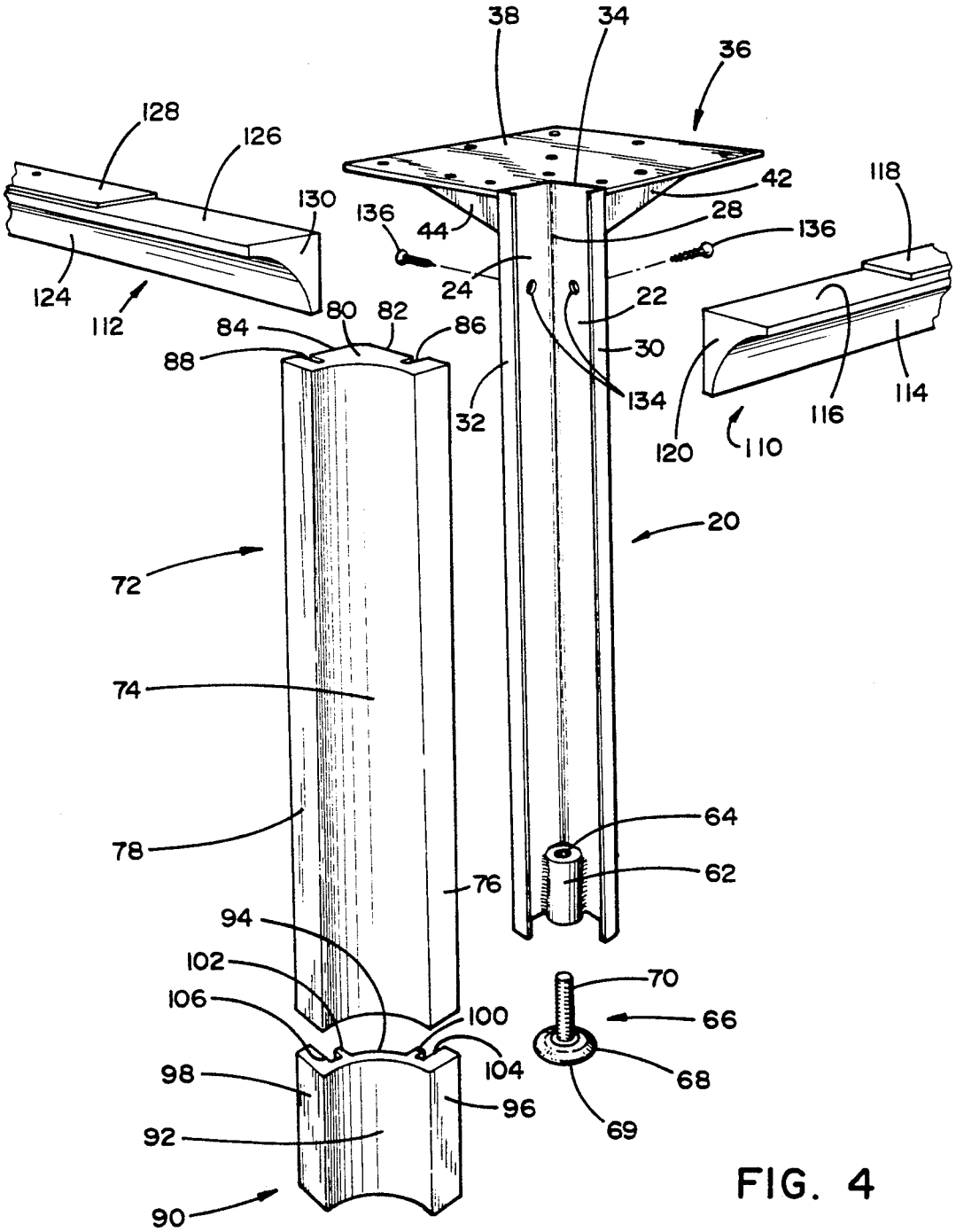
FIG. 4 is similar to FIG. 2 but is shown as an exploded view.

Referring to FIGS. 4 and 5, the table leg construction 18 includes an L-shaped metal leg 20 formed of two elongated plates 22, 24 which are integral and disposed at right angles to each other to thereby form a corner of the L-shaped metal leg 20. The corner has an inside surface 26 and an outside surface 28. Incidentally, it is to be understood that the terms "inside" and "outside" are defined as follows: if a vertical line is drawn through the geometric center of the horizontal support 12, an "inside" object is defined as an object which is relatively closer to this line than an "outside" object which is defined as an object which is relatively further from this line. Thus, as shown in FIG. 5, the inside corner surface 26 is closer to this imaginary vertical line than the outside corner surface 28.

As best seen in FIG. 5, each elongated plate 22, 24 of the L-shaped metal leg 20 includes a tongue 30, 32, respectively, which extends the length of the respective elongated plate 22, 24. These tongues 30, 32 are disposed at right angles to the respective elongated plates 22, 24. If the tongues 30, 32 extended further in their respective horizontal directions, the plates 22, 24 and the tongues 30, 32 would eventually form a cross-section in the nature of a square.

Referring to FIG. 4, an upper end of the L-shaped metal leg 20 is adapted to be received in a square cut-out portion 34 of a generally square metal plate 36. Preferably, the edges of the square metal plate 36 which define the square cut-out portion 34 are welded to the upper end of the L-shaped metal leg 20. As shown in FIGS. 3 and 4, the square metal plate 36 includes a top surface 38 and a bottom surface 40.

As shown in FIG. 3, a metal gusset 42 is formed in the nature of a right triangle and comprises a first side 46, a second side 48 and a hypotenuse 50. Similarly, a metal gusset 44 can be provided, the gusset 44 having a first side 52, a second side 54 and a hypotenuse 56. The first sides 46, 52 of the respective gussets 42, 44 can be secured to the bottom surface 40 of the square metal plate 36 by weldments 58. The second sides 48, 54 of the gussets 42, 44, respectively, can be mounted flush against the respective elongated plates 22, 24 by weldments 60. The metal gussets 42, 44 are preferably mounted to the square metal plate 36 and the elongated plates 22, 24, respectively, in such a manner that sufficient space or room is provided for a side valance 110 or an end valance 112, respectively, to extend to and abut the elongated plates 22, 24, respectively. The metal gussets 42, 44 provide additional strength and flexibility to the table leg construction 18.

Referring to FIG. 4, a glide support 62 can be mounted to the L-shaped metal leg 20 by welding the glide support 62 to the elongated plates 22, 24 at their lower portions at a position adjacent to the outside corner surface 28 of the L-shaped metal leg 20. The glide support 62 is provided with a threaded aperture 64 which is adapted to receive a glide 66. The glide 66 comprises a knob 68 mounted to a threaded shaft 70. The threaded shaft 70 of the glide 66 can be threadably received within the threaded aperture 64 of the glide support 62. By rotating the knob 68 of the glide 66, a bottom surface 69 of the knob 68 can be moved either upwardly or downwardly with respect to the glide support 62 and the floor or ground.

Referring to FIGS. 4 and 5, a wooden leg 72 is provided, the wooden leg 72 having a concave outside surface 74 and a leg portion 76 disposed near one end of the concave outside surface 74 and extending therefrom. Similarly, a leg portion 78 is disposed adjacent the opposing end of the concave outside surface 74 and extends therefrom. The wooden leg 72 includes a block portion 80 which is integral with the leg portions 76, 78. An exterior surface of the block portion 80 defines the concave outside surface 74 of the wooden leg 72. The block portion 80 includes a first surface 82 and a second surface 84 located in right angle relationship. The wooden leg 72 is formed with a longitudinal grove or channel 86 which separates the first surface 82 from the leg portion 76. Similarly, a longitudinal grove or channel 88 separates the second surface 84 from the leg portion 78.

As shown in FIG. 5, the longitudinal groves 86, 88 of the wooden leg 72 are adapted to slidably receive the tongues 30, 32, respectively, of the L-shaped metal leg 20. When the tongues 30, 32 of the L-shaped metal leg 20 are slidably received within the longitudinal groves 86, 88 of the wooden leg 72, the first surface 82 and the second surface 84 of the wooden leg 72 are preferably located in a parallel relationship with the elongated plates 22, 24, respectively.

Referring to FIG. 4, a glide cover 90 can be provided, the glide cover 90 having a configuration similar to the configuration of the wooden leg 72, but having a much shorter length. The glide cover 90 can be made of wood or any suitable material but is preferably formed of a thermoplastic material. If a thermoplastic material is used, the glide cover 90 can be injection molded or preferably extruded in a separate manufacturing operation. The glide cover 90 includes a concave outside surface 92 and a concave inside surface 94, the surfaces cooperating to form two opposing leg portions 96, 98. Extending inwardly from the concave inside surface 94 at respective positions which are near but spaced from the leg portions 96, 98, respectively, are thumb portions 100, 102, respectively. A longitudinal groove or channel 104 is thereby formed in the space between the thumb portion 100 and the leg portion 96, and a longitudinal groove or channel 106 is formed between the thumb portion 102 and the leg portion 98. Thus, the tongues 30, 32 of the L-shaped metal leg 20 can be slidably received within the longitudinal grooves 104, 106, respectively, of the glide cover 90.

Referring to FIG. 4, the table 10 is preferably provided with the side valance 110 and the end valance 112. The side valance 110 comprises an elongated block 114 having a top surface 116 and a strip 118 affixed to a central longitudinal portion of the top surface 116 of the side valance 110. Because of this construction, an end surface 120 of the side valance 110 can be disposed in flush relationship with the elongated plate 22 while the top surface 116 of the side valance 110 can be disposed flush with the bottom surface 40 of the square metal plate 36, as shown in FIGS. 3 and 4.

Similarly, the end valance 112 comprises an elongated block 124 including a top surface 126 having a strip 128 attached thereto. The end valance 112 includes an end surface 130 which is adapted to be disposed in flush relationship with the elongated plate 24 of the L-shaped metal leg 20 after the L-shaped metal leg 20 is mounted to the horizontal support 12. The top surface 126 of the end valance 112 can be disposed flush with the bottom surface 40 of the square metal plate 36, as shown in FIG. 3. As shown in FIG. 3, the side valance 110 and the end valance 112 can be secured to the bottom surface 16 of the horizontal support 12 by fasteners 132.

The table leg construction 18 can be easily assembled. First, as shown in FIG. 4, the glide support 62 is welded to a lower portion of the L-shaped metal leg 20. Next, the edges of the square cut-out portion of the generally square metal plate 36 are welded to the upper ends of the elongated plates 22, 24 of the L-shaped metal leg 20. The metal gussets 42, 44 are then welded to the square metal plate 36 and the L-shaped metal leg 20 as previously described. A welded metal assembly comprising the L-shaped metal leg 20, the square metal plate 36, the metal gussets 42, 44, and the glide support 62 is thereby formed. Preferably, this welded metal assembly is then painted.

Before proceeding with any further assembly steps, the wooden leg 72, the valances 110, 112, and the horizontal support 12 are preferably subjected to a suitable finishing operation. The bottom ends of the longitudinal grooves 86, 88 of the wooden leg 72 are then aligned with and slid over the top ends of the tongues 30, 32, respectively, of the L-shaped metal leg 20. In other words, starting at the top of the L-shaped metal leg 20, the wooden leg 72 is slid downwardly over the L-shaped metal leg 20 until the wooden leg 72 contacts the glide support 62.

Each elongated plate 22, 24 of the L-shaped metal leg 20 preferably includes a countersunk hole 134 adapted to receive a fastener 136. The fasteners 136 can be inserted through the countersunk holes 134 of the L-shaped metal leg 20 so that they bear against the surfaces 82, 84 of the wooden leg 72. Alternatively, the fasteners 136 can be threaded into the surfaces 82, 84 of the wooden leg 72. The fasteners 136 are used to fixedly mount the wooden leg 72 to the L-shaped metal leg 20.

Next, the glide cover 90 is slid over the lower portion of the L-shaped metal leg 20. Preferably, the fit between the L-shaped metal leg 20 and the glide cover 90 is a press fit relationship. The wooden leg 72 and the glide cover 90 together form a cover member which substantially fully conceals the L-shaped metal leg 20 when the table leg construction 18 is viewed from an outside position such as in FIG. 2.

The glide 66 can then be threaded into the glide support 62. Upon accomplishing these steps, the table leg construction 18 is assembled and ready to be secured to the bottom surface 16 of the table 10. Referring to FIG. 3, fasteners 138 can be used to secure the square metal plate 36 to the bottom surface 16 of the table 10. The side valance 110 and the end valance 112 can then be secured to the bottom surface 16 of the table 10 as previously described.

In light of the above detailed description, it is apparent that the present invention fills many needs of the prior art. The table leg construction 18 is strong and durable because the L-shaped metal leg 20 is entirely responsible for supporting the weight of the table 10, yet the table leg construction 18 retains a substantially wooden appearance. The table leg construction 18 is stronger than prior art leg constructions because the L-shaped metal leg 20 serves as the primary supporting or reinforcing element and the wooden leg 72 serves a primarily decorative function, rather than vice versa. The wooden leg 72 is easily mounted to the L-shaped metal leg 20 because of the tongue and groove connection wherein the tongues 30, 32 of the metal leg 20 are received in the longitudinal grooves 86, 88, respectively, of the wooden leg 72. In addition, this tongue and groove connection provides flexibility to the table leg construction 18 because only a small portion of the wooden leg 72 is rigidly secured to the L-shaped metal leg 20. This connection permits a substantial portion of the wooden leg 72 to flex with respect to the metal leg 20. Of particular importance, however, the wooden leg 72 can easily be replaced if ever damaged.

Reasonable variation and modification are possible within the scope of the foregoing specification and drawings without departing from the spirit of the invention. For example, the glide cover 90 can be eliminated and the wooden leg 72 can be made long enough to conceal the entire length of the L-shaped metal leg 20. Further, the leg construction 18 can be used with other articles of furniture such as chairs and the like. Still further, the leg 72 can be made of decorative materials other than wood. For example, the leg 72 can be made of a plastic material.

The embodiments for which an exclusive property or privilege is claimed are defined as follows:

1. In a leg construction for supporting the weight of an upper member in an article of furniture wherein the leg construction comprises an elongated metal support member adapted to be secured to the upper member and of a length to support the upper member above the floor, the improvement comprising:

a cross section of said metal support member comprising a concave portion having two ends and having an elongated edge extending from each said end, and outside surface and two elongated retaining tongues extending along at least a portion of the length of said elongated edges, the two elongated tongues being angled relative to said ends of said concave portion; and a one-piece elongated decorative cover member mounted on the metal support member and having a length substantially coextensive with the metal support member for covering the metal support member, the cover member further having two elongated retaining grooves for slidably receiving the elongated retaining tongues of the metal support member and thereby slidably retaining the cover member on the metal support member, whereby the cover member substantially conceals the metal support member from view from at least one side thereof.

2. A leg construction according to claim 1 wherein the decorative cover member comprises wood.

3. A leg construction according to claim 1 wherein the metal support member comprises two elongated plates, each having a first elongated edge, the elongated plates being mounted to each other along said first elongated edges such that said elongated plates are disposed at right angles to each other, whereby the metal support member has an L-shaped cross section.

4. A leg construction according to claim 1 wherein said cover member further comprises a concave outside surface.

5. A leg construction according to claim 1 wherein the cover member includes a block portion and two opposing leg portions. each of said leg portions cooperating with said block portion to form two of said elongated retaining grooves.

6. A leg construction according to claim 1 wherein said metal support member includes at least one aperture which receives a fastener, the fastener extending through said metal support member and bearing against said cover member for fixedly mounting said cover member to said metal support member.

7. A leg construction according to claim 1 further comprising a means attached to said metal support member for raising and lowering said metal support member with respect to the floor.

8. A table having a top and at least three leg constructions according to claim 1 secured to an undersurface of the top for supporting the top above the floor.

9. A leg construction according to claim 1 and further comprising at least one metal gusset secured to an underside of said metal plate and to said metal support member to rigidify the mounting of the plate to the metal support member.

10. In a construction for supporting the weight of an upper member in an article of furniture wherein the leg construction comprises an elongated metal support member adapted to be secured to the upper member and of a length to support the upper member above the floor, the improvement comprising:

said metal support member having two elongated retaining tongues extending along at least a portion of the length of said metal support member and two elongated plates, each having a first elongated edge, the elongated plates being mounted to each other along said first elongated edges such that said elongated plates are disposed at right angles to each other, whereby the metal support member has an L-shaped cross section, wherein each of said elongated plates further comprises a second elongated edge opposing said first elongated edge. and wherein said elongated retaining tongues are integral with the respective second elongated edges; and an elongated decorative cover member mounted on the metal support member and having a length substantially coextensive with the metal support member for covering the metal support member. the cover member further having two elongated retaining grooves for slidably receiving the elongated retaining tongues of the metal support member and thereby slidably retaining the cover member on the metal support member, whereby the cover member substantially conceals the metal support member from view from at least one side thereof.

11. A leg construction according to claim 10 further comprising a metal plate secured to an upper portion of said metal support member, wherein said metal plate is adapted to be securely mounted to a bottom surface of an upper member of an articles of furniture.

12. A leg construction according to claim 11 further comprising at least one metal gosset secured to an undersurface of said metal plate and to said metal support member in such a manner that sufficient space is provided for a valance to extend to and abut said metal support member.

13. An article of furniture having a generally horizontal upper member and at least three leg constructions according to claim 10 secured to an undersurface of the upper member for supporting the upper member above the floor.

14. A leg construction according to claim 10 wherein each of said elongated retaining tongues extends inwardly.

15. A leg construction according to claim 14 wherein each of said elongated retaining tongues is substantially perpendicular to the elongated plate from which it extends.

* * * * *